US006101848A

United States Patent [19]

Wang

[11] Patent Number: 6,101,848

[45] Date of Patent: Aug. 15, 2000

[54] COMPUTER CONTROLLED NEEDLE SELECTION STRUCTURE FOR A CIRCULAR KNITTING MACHINE

[75] Inventor: Ping-Shin Wang, Taipei Hsien, Taiwan

[73] Assignee: Pai Lung Machinery Mill Co., Ltd., Taipen Hsien, Taiwan

[21] Appl. No.: 09/368,518

[22] Filed: Aug. 5, 1999

[51] Int. Cl.[7] ..... D04B 9/06

[52] U.S. Cl. ..... 66/31; 116/216

[58] Field of Search ..... 66/8, 15, 17, 19, 66/31, 216, 217, 218, 222, 224, 225, 226, 227, 228

[56] References Cited

U.S. PATENT DOCUMENTS 5,042,274 8/1991 Maruyama et al. ..... 66/218

5,823,015 10/1998 Shibata ..... 66/218

*Primary Examiner*—Danny Worrell

*Attorney, Agent, or Firm*—Bacon & Thomas, PLLC

[57] ABSTRACT

A needle selection structure used in a rib knitting machine or interlocking knitting machine, which includes a computer-controlled needle selection unit arranged on a cover plate above a needle dial, and controlled by an external computer to move selection jacks, enabling plate needles to be selectively extended out to act with cylinder needles in knitting a yarn into a ribbed or interlocking fabric.

5 Claims, 9 Drawing Sheets

COMPUTER CONTROLLED NEEDLE SELECTION STRUCTURE FOR A CIRCULAR KNITTING MACHINE

BACKGROUND OF THE INVENTION

The present invention relates to a needle selection structure for a circular knitting machine, and more particularly to such a needle selection structure which is suitable for use in a rib knitting machine or interlocking knitting machine for a yarn into a ribbed or interlocking fabric.

A ribbed fabric has a certain flexibility and thickness, and is suitable for making clothes. When using a ribbed fabric to make clothes, it is not necessary to iron or calender the ribbed fabric because the rib border of a ribbed fabric does not curve. Because a ribbed fabric can easily be cut subject to the desired pattern, it is widely accepted by overcoat manufacturers. Because a rib-knitting machine is comprised of two sets of needles, it is superior over a plain knitting machine in pattern variation. A rib knitting machine is practical for knitting elastic fabric for making clothes, as well as for knitting a rib collar, rib cuff, rib trim, rib top, etc. Further, an interlocking knitting machine is similar to a rib-knitting machine. In early days, interlock fabrics were used for making underwear. Nowadays, interlock fabrics have been intensively used for making clothes. When a rib knitting machine or interlocking knitting machine is operated to knit a fabric, cylinder needles are lifted by cylinder cam, and plate needles are pushed outwards by a needle cam at a cover plate. The pattern formed by the knitting operation of the plate needles and the cylinder needles is determined subject to the paths of the cylinder cam and the needle cam. When changing to another pattern, the paths of the cylinder cam and the needle cam must be changed. It is time and labor consuming to change the path of the cylinder cam and the needle cam.

SUMMARY OF THE INVENTION

The present invention has been accomplished under the circumstances in view. The present invention provides a computer-controlled selection unit installed in the knitting machine. The needle selection unit is controlled by an external computer to drive plate needles, causing the plate needles to match with cylinder needles in knitting a yarn into a ribbed or interlocking fabric. According to the present invention, the needle selection structure comprises a computer-controlled needle selection unit. The computer-controlled needle selection unit comprises a selecting device, and a set of selection jacks driven by the selecting device. The selecting device is controlled by an external computer, having a plurality of needle selection legs corresponding to the butt at each of the selection jacks. Each needle selection leg has a sloping face for the passing of the butt of the corresponding selection jack. Each selection jack comprises a jack body moved on the upper needle dial. The jack body comprises a front coupling portion for coupling to a rear coupling portion at the rear end of the corresponding plate needle, a rear guide butt moved with the jack body in a track at a cap, and a bearing butt spaced between the front coupling portion and the rear guide butt for pushing by one needle selection leg of the selecting device. The cap is provided beneath the cover plate, comprising a track, which receives each selection jack, and a return portion sloping in one direction for guiding the rear guide butt of the selection jack back to the cap.

DETAILED DESCRIPTION OF THE PREFERRED EMBODIMENT

Figure 1:
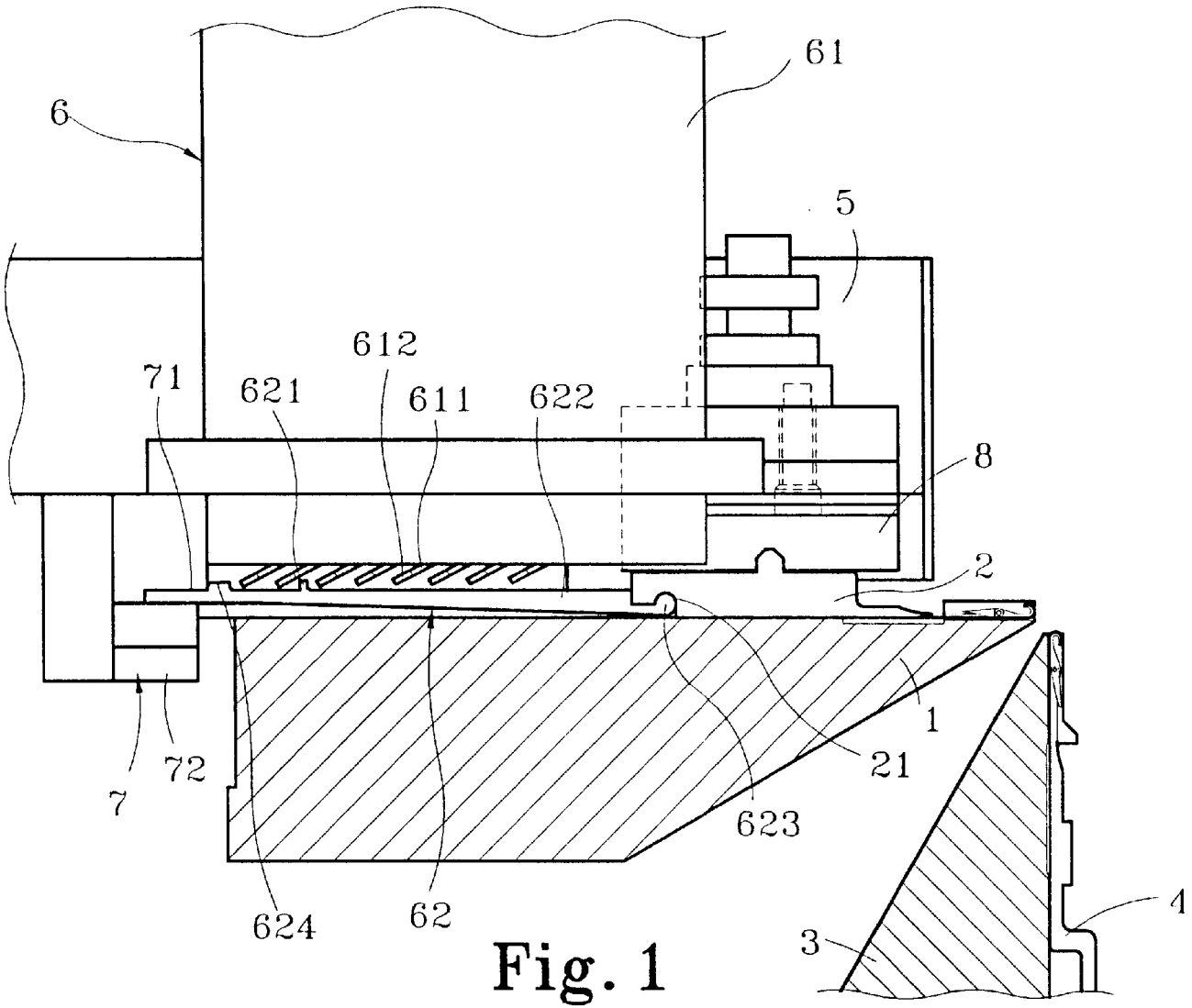
FIG. 1 is a schematic drawing showing the position of the computer-controlled selector unit at the upper needle dial.
Figure 2:
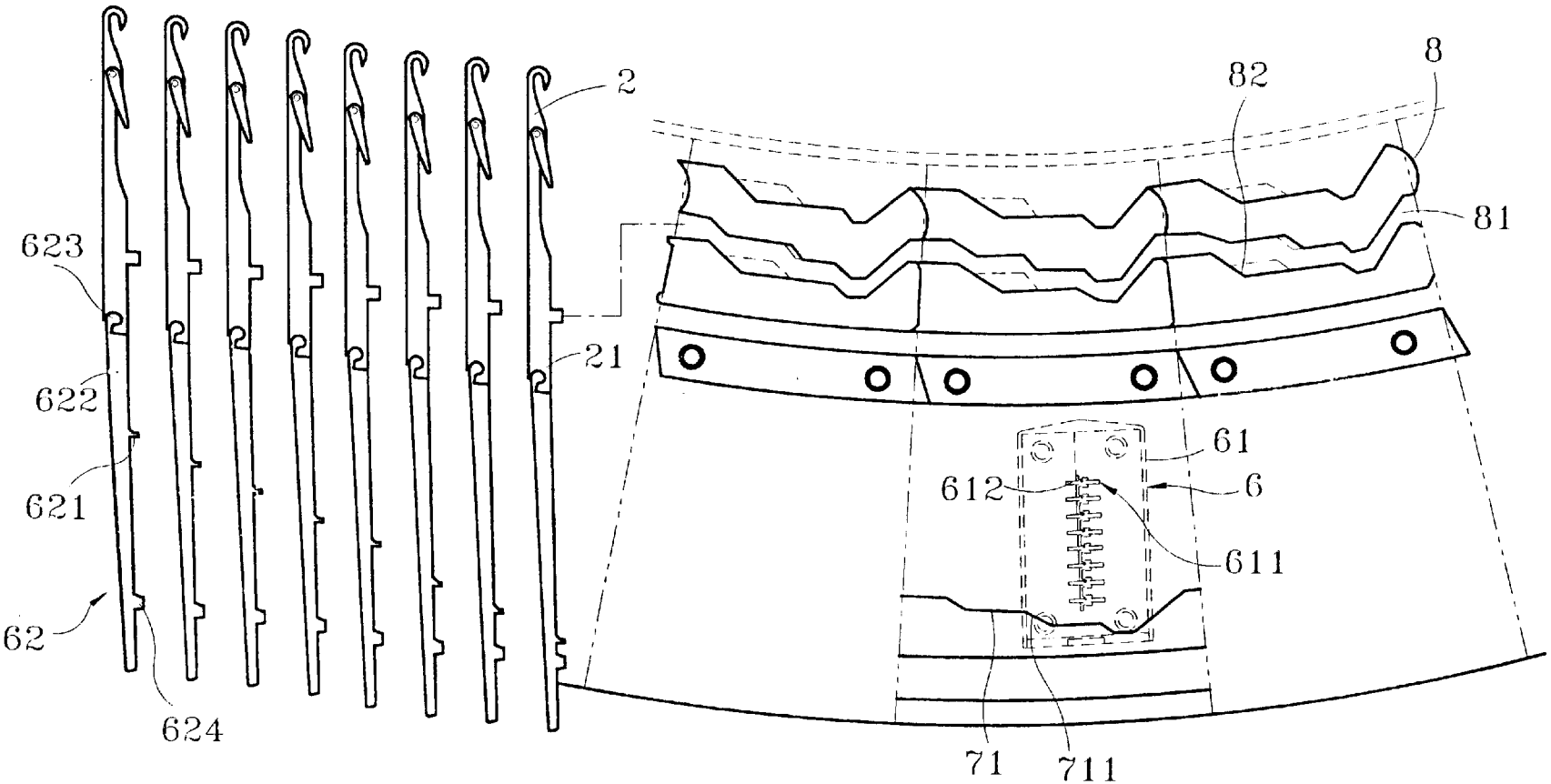
FIG. 2 is an extended out view of FIG. 1.

Referring to FIGS. 1 and 2, a computer-controlled needle selection unit is designed for use in a rib-knitting machine or interlocking knitting machine The knitting machine comprises a needle dial 1, a set of plate needles 2 arranged on the needle dial 1, a needle cylinder 3, and a set of cylinder needles 4 arranged on the needle cylinder 3. During knitting, the cylinder needles 4 are lifted by a needle lifting cam (not shown), and plate needles 2 are pushed outwards by a needle push jack at a cover plate 5, therefore loop-forming knitting are simultaneously or alternatively achieved. However, this knitting method can only produce a single ribbed or interlocking texture. In order to provide the ribbed or interlocking texture with a jacquard pattern, the present invention adds a computer-controlled needle selection unit 6 to the cover plate 5 above the upper needle dial 1.

The computer-controlled needle selection unit 6 comprises a selecting device 61, and a set of selection jacks 62 driven by the selecting device 61. The selecting device 61 is controlled to operate by an external computer, having a plurality of needle selection legs 611. Each of the needle selection legs 611 has a sloping face 612. Each selection jack 62 comprises a jack body 622 moved on the upper needle dial 1. The jack body 622 comprises a front coupling portion 623 for coupling to a rear coupling portion 21 at the rear end of the corresponding plate needle 2, a rear guide butt 624 moved with the jack body 622 in a track 71 at a cap 7, and a bearing butt 621 spaced between the front coupling portion 623 and the rear guide butt 624 for pushing by one needle selection leg 611 of the selecting device 61.

The cap 7 is provided beneath the cover plate 5, comprising a track 71, which receives the selection jack 62, and a return portion 72 sloping in one direction for guiding the rear guide butt 624 of the selection jack 62 back to the cap 7.

Figure 4A:
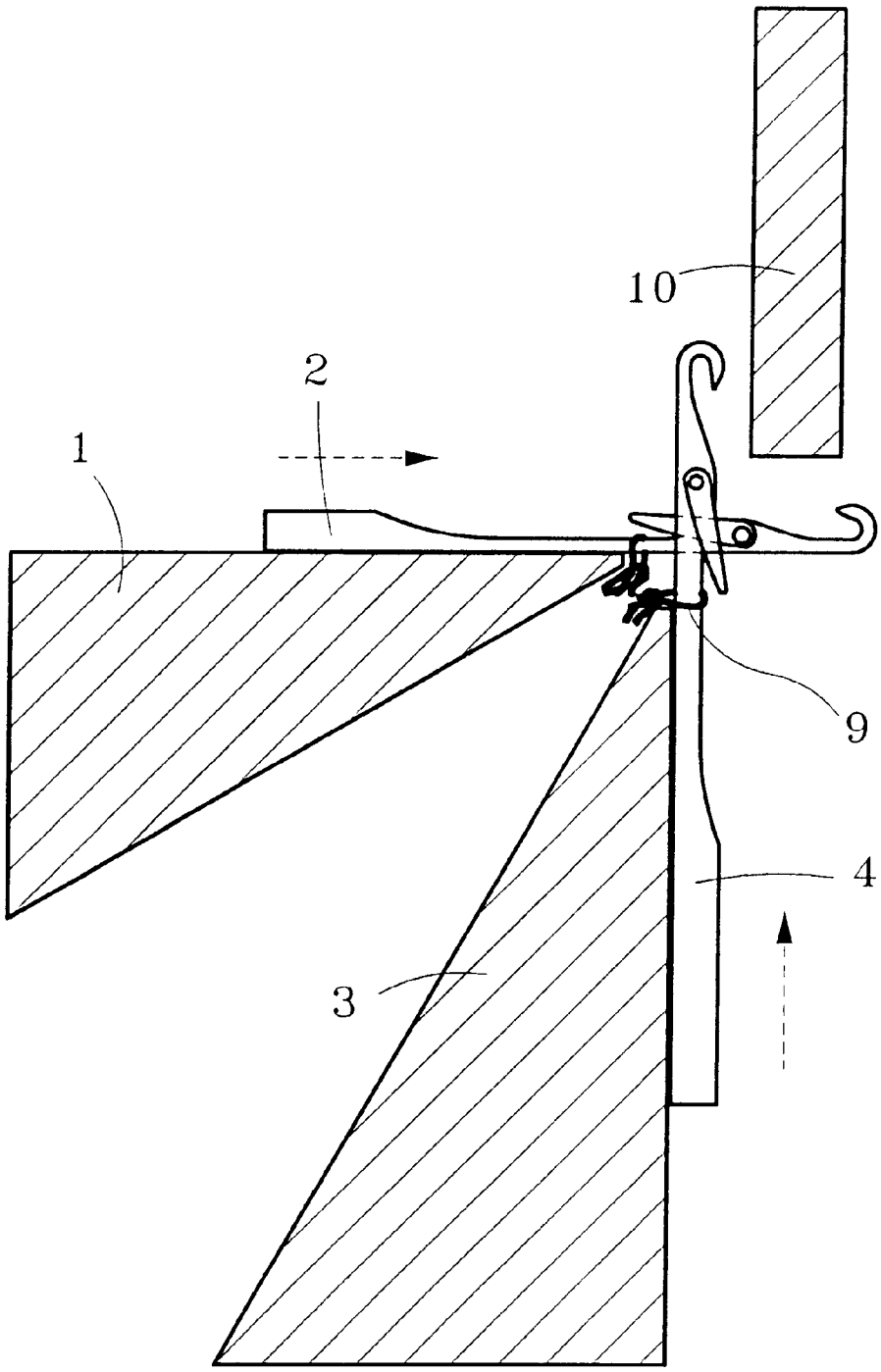
FIGS. 4A–4C show the knitting operation of the plate needles and the cylinder needles according to the present invention.
Figure 4B:
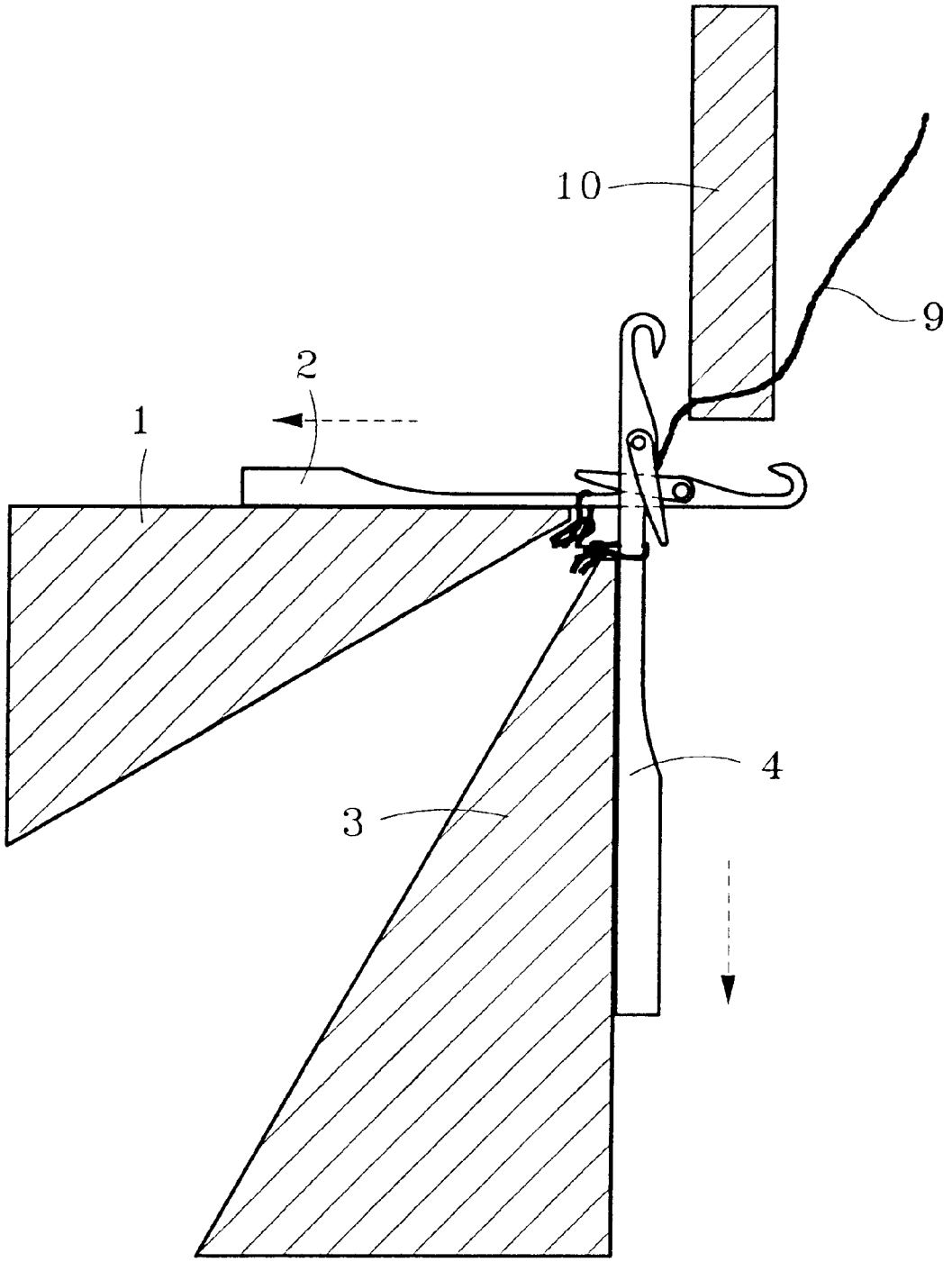
Figure 4C:
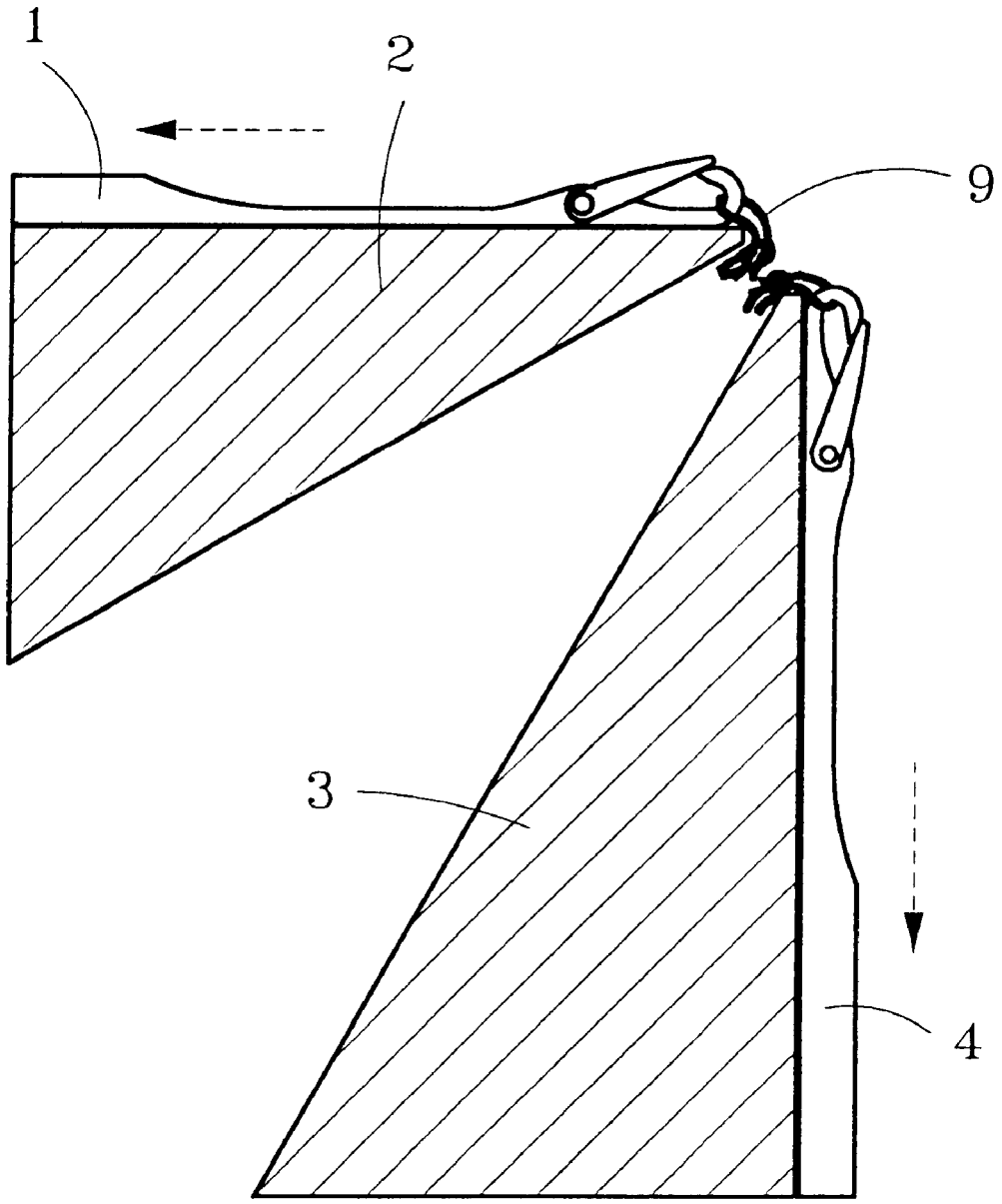

Referring to Figures from 3A through 3D, during loop knitting, the cylinder needles 4 are lifted by the needle cam (not shown) at the needle cylinder 3, and the plate needles 2 are pushed outwards by the needle cam 8 at the front side of the cover plate 5, thereby causing the plate needles 2 and the cylinder needles 4 to alternatively hook up the yarn 9, then the plate needles 2 are retracted and the cylinder needles 4 are lowered, thereby causing loops to be alternatively or simultaneously formed (see FIGS. 4A, 4B and 4C).

Figure 3A:
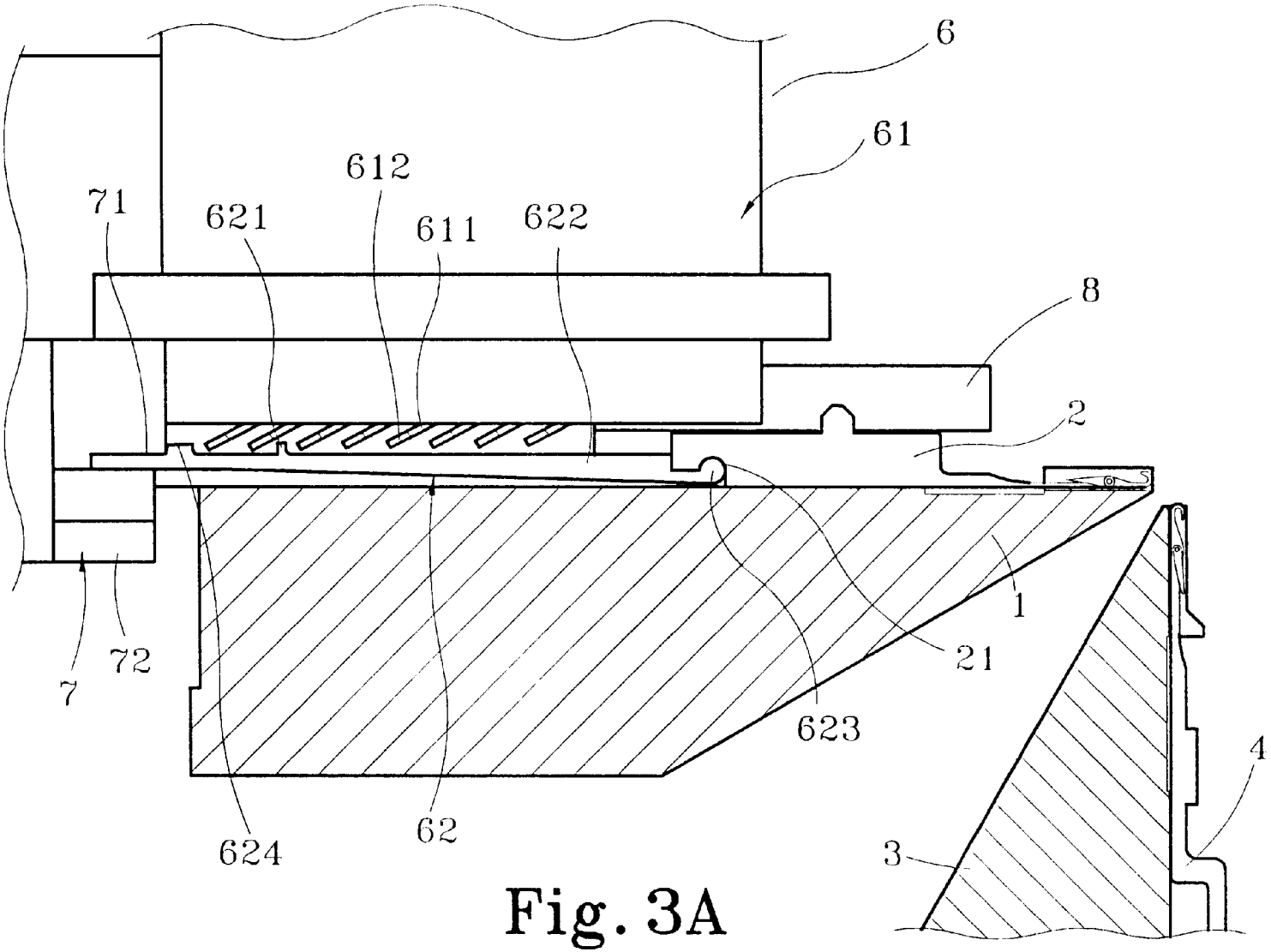
FIG. 3A is a side view of the present invention.
Figure 3B:
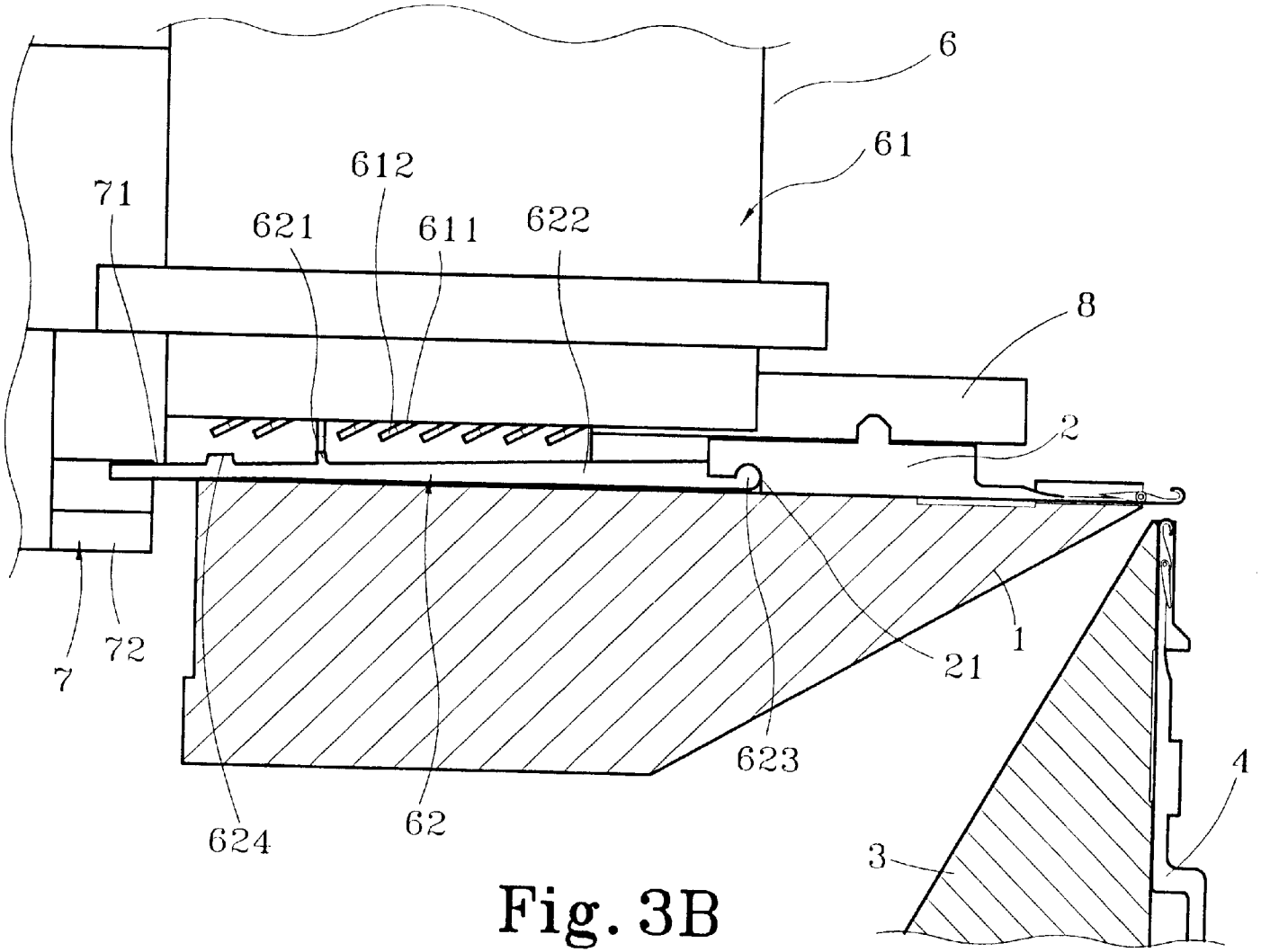
FIG. 3B is similar to FIG. 3A but showing the computer-controlled selector unit operated.
Figure 3C:
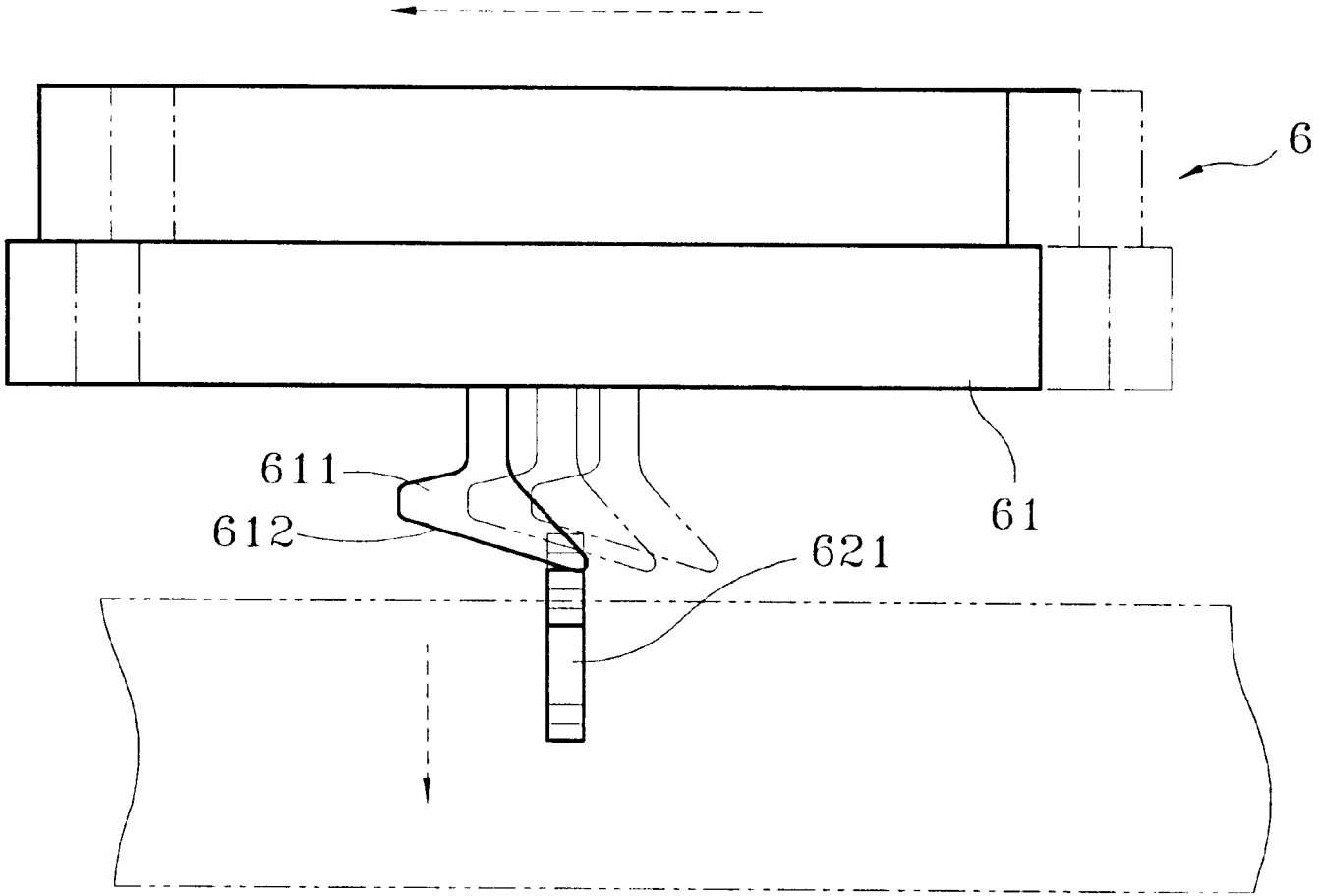
FIG. 3C is a top view of FIG. 3A.
Figure 3D:
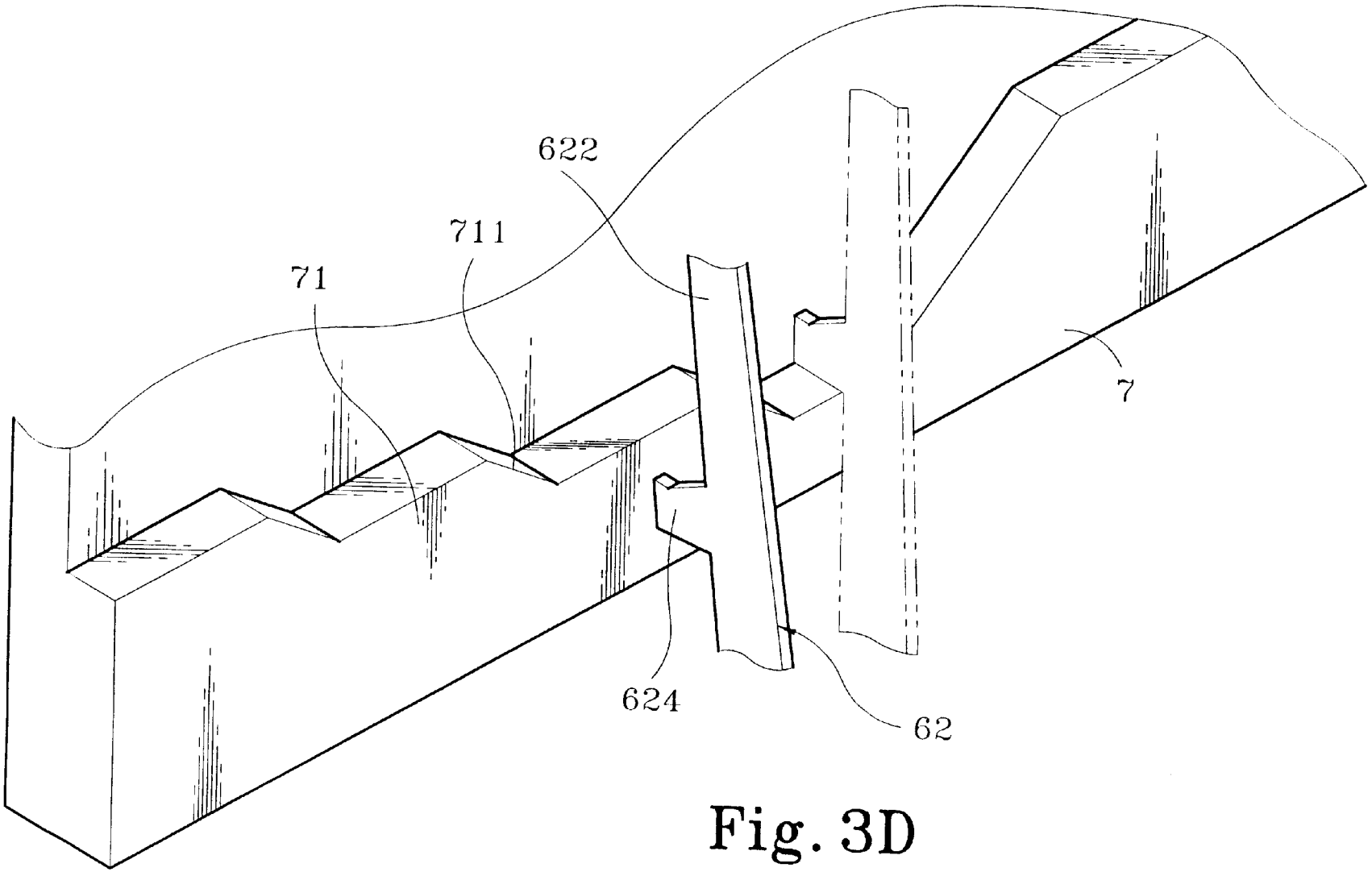
FIG. 3D is an enlarged view of a part of FIG. 3C.

When the external computer is operated to control the selecting device 61, the needle selection legs 611 are turned up and down. When turning upwards, the needle selection legs 611 are moved to the selection jack 62, and the sloping face 612 of one needle selection leg 611 is pressed on the bearing butt 621 at the selection jack 62, causing the selection jack 62 to sink (see FIGS. 3B and 3C). When the selection jack 62 is lowered, the rear guide butt 624 of the selection jack 62 is moved away from the track 71 at the cap 7 (see FIG. 3D), and therefore the rear guide butt 624 of the selection jack 62 passes through the outside of the track 71, and the selection jack 62 does not push the corresponding plate needle 2 to make a jacquard knitting, i.e., the corresponding plate needle 2 is reciprocated in the track 81 at the needle cam 8. After the end of the aforesaid action, the return portion 72 of the cap 7 guides the guide butt 624 of the selection jack 62, thereby causing the selection jack 62 to be moved back to the cap 7.

When turning downwards, the needle selection legs 611 are moved through the gaps between each two selection jacks 62, and the guide butt 624 is moved with the respective selection jack 62 in the track 71 at the cap 7, and when the cam 711 of the track 71 is moved to the guide butt 624, the corresponding plate needle 2 is pushed outwards by the cam 82 at the track 81 at the needle cam 8 to achieve a jacquard knitting action.

As indicated above, when the selection jack 62 is not selected, the corresponding plate needle 2 achieves a jacquard knitting at the cam 711 in the track 71 at the cap 7. If the selection jack 62 is selected, the corresponding plate needle 2 is moved subject to the track 81 at the needle cam 8. Under the control of the external computer, the computer-controlled needle selection unit 6 is operated to selectively move the plate needles 2, causing the plate needles 2 and the cylinder needles to knit the yarn into a ribbed or interlocking fabric.

While only one embodiment of the present invention has been shown and described, it will be understood that various modifications and changes could be made thereunto without departing from the spirit and scope of the invention disclosed.

What is claimed is:

1. A needle selection structure arranged on an upper needle dial in a rib knitting machine or interlocking knitting machine for driving plate needles at the upper needle dial to act with cylinder needles on a needle cylinder to produce a ribbed or interlocking fabric, the needle selection structure comprising:

a computer-controlled needle selection unit arranged on a cover plate above said needle dial, said computer-controlled needle selection unit comprising a selecting device, and a set of selection jacks driven by said selecting device;

a cap arranged below said cover plate, said cap comprising a guide track for moving said selection jacks, and a sloping return portion for guiding said selection jacks back to said cap; wherein said computer-controlled needle selection unit is controlled by an external computer to drive said selection jacks, causing said selection jacks to move said plate needles, so that said plate needles and said cylinder needles are driven to knit a yarn into a ribbed or interlocking fabric.

2. The needle selection structure of claim 1 wherein said selecting device comprises a plurality of needle selection legs, said needle selection legs each having a sloping face.

3. The needle selection structure of claim 1 wherein said selection jacks each comprise a jack body, said jack body comprising a front coupling portion for coupling to a rear coupling portion at one plate needle, a rear guide butt moved with said jack body in the guide track at said cap, and a bearing butt spaced between said front coupling portion and said rear guide but for pushing by one needle selection leg of said selecting device.

4. The needle selection structure of claim 1 wherein said upper needle dial comprises a needle cam, said needle cam comprising a track and a cam at the track.

5. The needle selection structure of claim 1 wherein said return portion of said cap slopes in one direction.

* * * * *